United States Patent [19]

Kurth

[11] 4,205,868

[45] Jun. 3, 1980

[54] SAFETY DEVICE FOR LOCKING AND UNLOCKING MOTOR VEHICLE DOORS

[75] Inventor: Hermann W. Kurth, Sindelfingen, Fed. Rep. of Germany

[73] Assignee: Daimler-Benz Aktiengesellschaft, Stuttgart, Fed. Rep. of Germany

[21] Appl. No.: 913,054

[22] Filed: Jun. 6, 1978

[30] Foreign Application Priority Data

Jun. 8, 1977 [DE] Fed. Rep. of Germany ..... 2725945

[51] Int. Cl.[2] ..... E05C 13/00

[52] U.S. Cl. ..... 292/347; 292/1; 292/346; 292/336.3

[58] Field of Search ..... 292/336.3, 347, 1, 216, 292/346; 70/181, 452, 408, 456 R

[56] References Cited

U.S. PATENT DOCUMENTS

| | | | |
|---|---|---|---|
| 2,629,057 | 2/1953 | Heinz | 70/452 X |
| 2,939,307 | 6/1960 | Trammell, Jr. | 70/181 |
| 2,955,858 | 10/1960 | Trammell, Jr. | 292/347 X |
| 3,612,588 | 10/1971 | Roppo | 292/1 |
| 3,792,883 | 2/1974 | Juarbe | 292/1 |

*Primary Examiner*—Richard E. Moore

*Attorney, Agent, or Firm*—Craig & Antonelli

[57] ABSTRACT

A safety installation for locking and unlocking motor vehicle doors which includes an actuating knob arranged on the door inner side; the actuating knob is thereby constructed as sliding knob arranged on the top side of the windowsill.

4 Claims, 3 Drawing Figures

SAFETY DEVICE FOR LOCKING AND UNLOCKING MOTOR VEHICLE DOORS

The present invention relates to a safety installation for the locking and unlocking of motor vehicle doors which includes an actuating knob arranged at the inner side of the door.

The door locking knobs for motor vehicles which are used at present offer no effective protection against break-in into the vehicles. Thus, the known cylindrical locking knobs which are movable in the vertical direction can be readily pulled upwardly by means of a sling when they project in the locked position above the windowsill, and a rod suffices with pressure-actuated knobs in order to push the locking knobs downwardly and therewith unlock the doors. Known rectangular or square knobs can also be actuated by means of a sling or by means of a hook. As to the rest, the button-shape thereby plays practically no significant role; since the knob or button must be capable of being readily gripped with the fingers, it also offers always a point of engagement for an actuation by means of break-in tools.

Knobs or buttons located recessed in the windowsill in the locked position entail the disadvantage that the doors cannot be unlocked by means of the knob or button. They are therefore usable only for two-door vehicles because the driver could not unlock the rear doors.

Locking elements which are arranged at or mounted on the vertical inner door sheet-metal panel, offer a great protection against break-in but entail considerable comfort disadvantages; thus, for example, the visual control is not possible or possible only poorly, and also their application is similarly limited to two-door vehicles.

The present invention is therefore concerned with the task to avoid these disadvantages of the prior art locking knobs or buttons and to provide a locking installation which, at any rate, is far-reachingly more safe against break-in, offers high actuating comfort, and is usable also for four-door vehicles.

The underlying problems are solved according to the present invention in that the actuating knob is constructed as sliding knob arranged on the top side of the windowsill.

A particularly high safety against break-in is attained if the sliding knob is arranged recessed, is covered off toward the top and is accessible from the side.

In order to enable a completely satisfactory visual control, the covering should thereby consist of transparent material.

Accordingly, it is an object of the present invention to provide a safety installation for the locking and unlocking of motor vehicle doors which avoids by simple means the aforementioned shortcomings and drawbacks encountered in the prior art.

Another object of the present invention resides in a safety device for locking and unlocking motor vehicle doors which provides a far-reaching safety and protection against break-ins.

A further object of the present invention resides in a safety installation for locking and unlocking motor vehicle doors which effectively minimizes the danger of an unauthorized opening of the door by the use of break-in tools capable of unlocking the door from the outside.

A still further object of the present invention resides in a safety installation for locking and unlocking motor vehicle doors which enable good visual control and can be used both with two-door vehicles as also with four-door vehicles.

Still another object of the present invention resides in a locking and unlocking arrangement of motor vehicle doors which assures a high safety against break-in without sacrifice in actuating and operating comfort.

These and other objects, features and advantages of the present invention will become more apparent from the following description when taken in connection with the accompanying drawing which shows, for purposes of illustration only, two embodiments in accordance with the present invention, and wherein.

Figure 1:
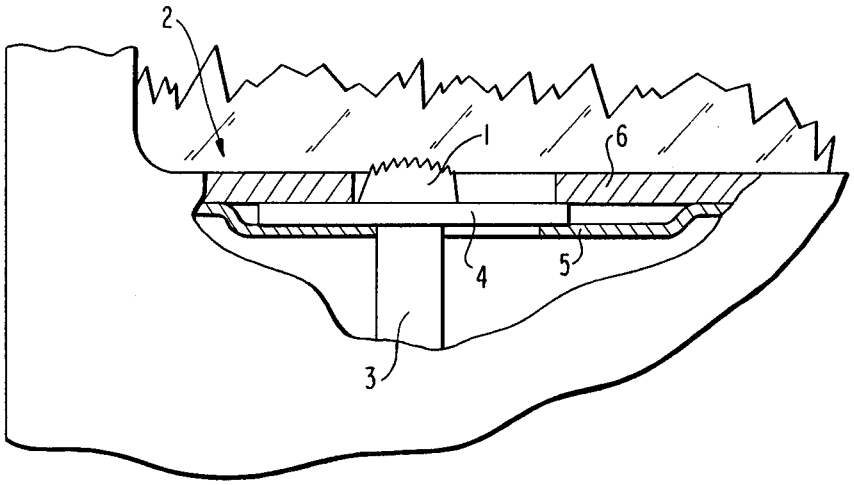
FIG. 1 is a side elevational view, partly in cross section, of a sliding knob arrangement for a door-locking mechanism in accordance with the present invention.

Referring now to the drawing wherein like reference numerals are used throughout the various views to designate like parts, the sliding knob 1 illustrated in FIG. 1 of the drawing is arranged within the area of the top side of the windowsill generally designated by reference numeral 2 and is connected with the door lock by way of a linkage 3 in a conventional manner, not illustrated in detail. A plate 4, which extends between the inner sheet-metal door panel 5 and the door covering 6, serves for the guidance of the sliding knob 1.

Figure 2:
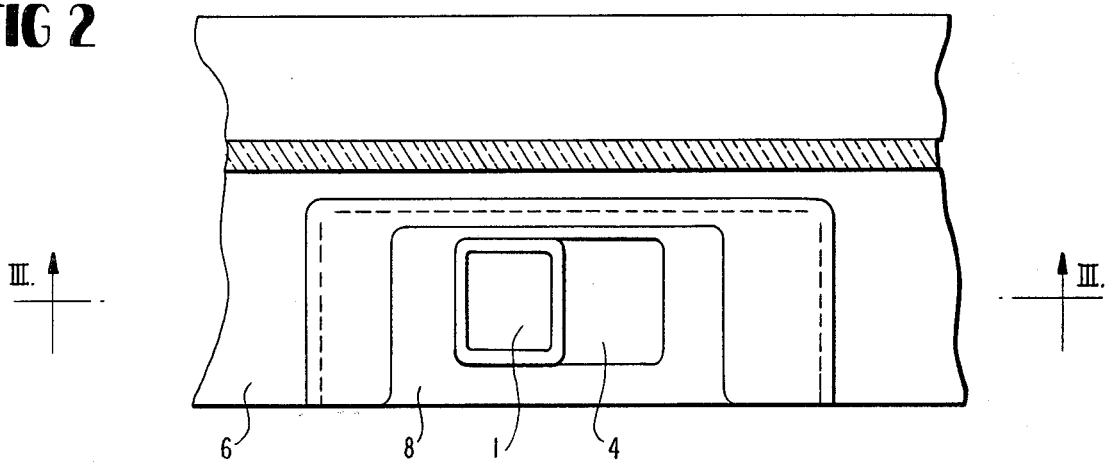
FIG. 2 is a partial plan view on a modified embodiment of a door-locking mechanism with a sliding knob arranged recessed in accordance with the present invention.
Figure 3:
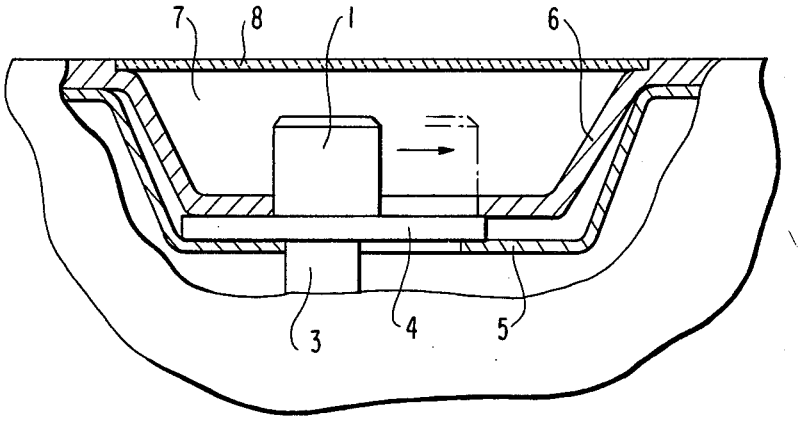
FIG. 3 is a cross-sectional view taken along line III—III of FIG. 2.

In the embodiment of the present invention illustrated in FIGS. 2 and 3, the windowsill includes within the area of the sliding knob 1 a recess or trough 7 which is covered off by a transparent plate 8. The sliding knob 1 is therefore actuated from the side and is particularly safe against break-in—because it is inaccessible from the top.

It would be feasible also within the scope of the present invention to achieve an additional blocking of the knob by the insertion of a shaped part between the sliding knob and the guidance thereof.

The side of the sliding knobs facing the interior space and/or the one-half of the plate 4 may be treated with a fluorescent coloring material or phosphorescent paint so that a good visual control is possible also in darkness.

With the application of such sliding knobs to rear doors, the advantage is additionally achieved that the entire arrangement is considerably simplified by the elimination of deflection levers with bearing support and actuating elements and a further break-in possibility is thereby eliminated.

While I have shown and described two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. In a safety installation for motor vehicle doors of the type having an actuating knob mounted for sliding movement, between positions locking and unlocking a vehicle door, by direct digital manipulation manipulation of the actuating knob, the improvement comprising a trough formed in an upper end of a windowsill and open at an inner side of the door for providing access for said direct digital manipulation, and said trough being closed in an upward direction by a wall of transparent material.

2. A safety installation according to claim 1, wherein said actuating knob is upwardly directed and guided forwardly and rearwardly in a bottom wall of said trough, and wherein the wall covering the trough from above, lies substantially flush with an upper surface of the windowsill.

3. In a safety installation for motor vehicle doors of the type having an actuating knob mounted for sliding movement, between positions locking and unlocking a vehicle door, by direct digital manipulation of the actuating knob, the improvement comprising a trough formed in an upper end of a windowsill and open at an inner side of the door for providing access for said direct digital manipulation, and said trough being closed in an upward direction by a wall lying in a common plane with an upper surface of said windowsill, said actuating knob being forwardly and rearwardly guided in a bottom wall of said trough and extending upwardly toward said wall.

4. A safety installation according to claim 1, 2, or 3, characterized in that at least one of the two parts consisting of the side of the sliding knob facing the interior space of the vehicle and one-half of the cover means are treated with fluorescent color to enable good visual control also in darkness.

* * * * *